US006019528A

United States Patent [19]

Martinez et al.

[11] Patent Number: 6,019,528

[45] Date of Patent: Feb. 1, 2000

[54] COMPACT RIBBON CASSETTE WITH MESHING GEAR POSITIVE DRIVE

[75] Inventors: Phillip M. Martinez, Groton; Scott J. Longrod, Lansing, both of N.Y.

[73] Assignee: Axiohm Transaction Solutions, Inc., Blue Bell, Pa.

[21] Appl. No.: 09/130,715

[22] Filed: Aug. 7, 1998

[51] Int. Cl.[7] ..... B41J 35/28

[52] U.S. Cl. ..... 400/208; 400/235

[58] Field of Search ..... 400/207, 208, 400/208.1, 206.3, 206.4, 235, 235.1

[56] References Cited

U.S. PATENT DOCUMENTS

| | | | |
|---|---|---|---|
| 3,897,866 | 8/1975 | Mueller | 400/208 |
| 3,927,747 | 12/1975 | Wolowitz | 400/208 |
| 3,981,387 | 9/1976 | Gottschlich | 400/196 |
| 4,367,052 | 1/1983 | Steger | 400/208 |
| 4,467,976 | 8/1984 | Bogaczyk et al. | 400/208 |
| 4,840,502 | 6/1989 | Grey | 400/196 |
| 5,487,615 | 1/1996 | Hayao | 400/208 |

*Primary Examiner*—Ren Yan
*Assistant Examiner*—Leslie J. Grohusky
*Attorney, Agent, or Firm*—Salzman & Levy

[57] ABSTRACT

A compact ribbon cassette for dispensing and storing a ribbon or tape upon integrally formed dispensing and storage spools. The dispensing and storage spools are disposed upon a common rotatable shaft mounted for rotation within the housing. A pair of meshing gears provide a positive ribbon drive that ensures that fresh ribbon is in place at the thermal print head for each MICR encode operation. The meshing gear positive ribbon drive system provides the optimum amount of ribbon for the print cycle to assure that MICR encode characters meet accepted industry quality standards.

10 Claims, 4 Drawing Sheets

COMPACT RIBBON CASSETTE WITH MESHING GEAR POSITIVE DRIVE

FIELD OF THE INVENTION

The present invention relates to ribbon cassettes for storing and dispensing tapes and, more particularly, to a compact ribbon cassette containing a thermal transfer printing ribbon that is both dispensed from and stored upon a common rotative shaft. A meshing gear positive drive moves a predetermined amount of spent ribbon from the print station ensuring that fresh ribbon is always in place for printing the next MICR character on a check.

BACKGROUND OF THE INVENTION

In the field of modern transaction printers, the objective is to provide simple, compact machines that are easy both to operate and to load. Modern transaction or receipt printers are increasingly called upon to perform a variety of printing functions on a wide range of different paper documents. When a merchant accepts a check for payment for goods or services, it is desirable to verify that the check is drawn on a good account. Magnetic Ink Character Recognition (MICR) readers for reading the bank information encoded on bottom of checks have long existed as stand-alone units. More recently, the MICR readers have been packaged inside the transaction printer so that not only may the MICR characters be read and the account verified, the merchant's check endorsement may be printed on the back of the check in the same operation. The next logical extension of combining functions within transaction printers is to combine a MICR inscribing or encoding station also within the printer. The inscriber prints the amount for which the check has been written using magnetic ink in a predefined amount field area of the check thereby eliminating either a secondary check handling operation at the merchant, a service bureau, or at the bank receiving the merchant's deposit. Banks increasingly are charging commercial depositors a per-check fee for inscribing the amount field. This makes the inscribing operation at the point-of-sale terminal even more desirable. Transaction printers must be compact and the addition of a MICR-encoding station has necessitated skillful design which has required the use of an extremely compact ribbon cassette for holding the special MICR ribbon for the encoder. The present invention provides a cassette containing a thermal transfer MICR printing tape or ribbon that is both dispensed from and stored upon spools on a common rotative shaft. The new, compact ribbon cassette takes the place of cassettes having spaced-apart, individual, dispensing and storage spools that divide the dispensing and storage functions. Such prior art spools require considerable space within the printer housing. A meshing gear direct drive system pulls spent ribbon from the thermal print station thereby guaranteeing that fresh ribbon is in place for the printing of the next MICR character on the check. In addition, the meshing gear drive system allows ribbon to be moved with such precision that essentially no extra ribbon need be advanced thus insuring long ribbon life (i.e., the maximum number of MICR encodes for a given ribbon length). More importantly, it has been found that a precise ribbon feed system is essential to printing MICR characters that meet industry accepted standards of quality.

The invention provides a new style of ribbon cassette for transaction printers that vertically stacks the dispensing spool upon the storage spool. The dispensing and storage spool are supported upon a common shaft that is rotatively supported within the cassette housing.

The new ribbon cassette has a cover plate that contains integrally formed leaf springs designed to bear upon a friction plate disposed over the wound dispensing ribbon. The cover plate provides biasing against the friction plate, which in turn causes a frictional loading or back drag upon the wound dispensing ribbon spool. The friction exerted upon the dispensing ribbon spool by the friction plate maintains a tension upon the dispensing spool of tape; the tape is thus kept taught as it is dispensed from the spool. This eliminates loosely formed intervals or slack in the tape as it is dispensed.

A uniquely formed chevron, disposed adjacent the dispensing and storage spools, allows for the tape to change elevation and reverse direction from the dispensing spool to the storage spool. The changing of elevation allows the dispensing spool and the storage spool to be compatibly disposed for rotation upon the same shaft. In other words, the tape is dispensed from the upper, dispensing spool, changes elevation, and is then wound upon the lower storage spool.

A pair of meshing gears is provided. One gear is rotatively mounted within the housing of the cassette, and the other is mounted on a pivoting arm 52 biased towards the first gear. The moving, spent ribbon passes between these meshing gears, thus causing the ribbon to be positively advanced without slippage through the cassette.

SUMMARY OF THE INVENTION

In accordance with the present invention, there is provided a ribbon cassette for supplying a printing tape for encoding MICR information on a check in a transaction printer. The ribbon cassette is constructed with both a dispensing spool and a storage spool integrally formed and supported about a common rotatable shaft rotatively mounted in the cassette housing. The dispensing spool and the storage spool rotate in the same direction about the rotative shaft. A uniquely formed chevron, disposed in the housing, allows for the tape to change elevation and reverse direction from the dispensing spool to the storage spool. The reversal of direction allows the dispensing spool and storage spool to be compatibly disposed for rotation upon the common shaft. The ribbon of the dispensing spool is in contact with a friction plate that bears against the wound edges of the dispensing ribbon. A cover plate for the cassette housing is disposed over the friction plate. The cover plate contains integrally formed leaf springs that are designed to bear upon the friction plate disposed over the wound dispensing ribbon. The cover plate provides biasing against the friction plate, which in turn causes a frictional loading upon the wound dispensing ribbon which varies depending upon the remaining quantity of ribbon remaining on the dispensing spool. The friction exerted upon the dispensing ribbon by the friction plate maintains a tension upon the dispensing spool; the ribbon is thus kept taught as it is dispensed from the spool. This eliminates loosely formed intervals or slack in the ribbon during dispensing which could cause poorly formed MICR characters to be printed on the check. A pair of meshing gears is provided. One gear is rotatively mounted within the housing of the cassette, and the other gear is mounted to a pivoting arm 52 outside the housing and biased to the gear in the housing. The moving, spent ribbon passes between these meshing gears, thus causing the ribbon to be positively advanced without slippage through the cassette.

It is an object of the invention to provide an improved, compact ribbon cassette.

It is another object of this invention to provide a ribbon cassette that has integrally formed dispensing and storage spools disposed about a common rotative shaft.

It is a further object of the invention to provide a meshing gear ribbon drive system that guarantees a precise, non-slip increment of ribbon will be fed to the thermal print head for the next MICR character.

It is another object of the invention to provide a meshing gear ribbon drive that allows precision advance of the spent ribbon thereby maximizing the quality of printing of MICR characters to assure compliance with industry standards.

It is an additional object of the invention to provide a ribbon cassette with an end-of-ribbon indicating means which signals a ribbon out condition while there is still enough ribbon to complete at least the MICR encoding transaction in process.

BRIEF DESCRIPTION OF THE DRAWINGS

A complete understanding of the present invention may be obtained by reference to the accompanying drawings, when considered in conjunction with the subsequent detailed description, in which.

For purposes of brevity and clarity, like elements and components will bear the same numbering and designations throughout the figures.

DESCRIPTION OF THE PREFERRED EMBODIMENT

Generally speaking, the invention comprises a compact ribbon cassette for dispensing and storing a ribbon or tape upon integrally formed, coaxial dispensing and storage spools. The dispensing and storage spools are disposed upon a common rotatable shaft mounted for rotation within the housing. A unique chevron disposed adjacent the dispensing spool causes the dispensed ribbon to change elevation and reverse direction, so as to be presentable for storage upon the storage spool coaxially mounted with the dispensing spool. A window in the housing disposed adjacent the chevron provides a means for detecting the end portion of the dispensed ribbon, thereby alerting the operator to replace the cassette.

Figure 1:
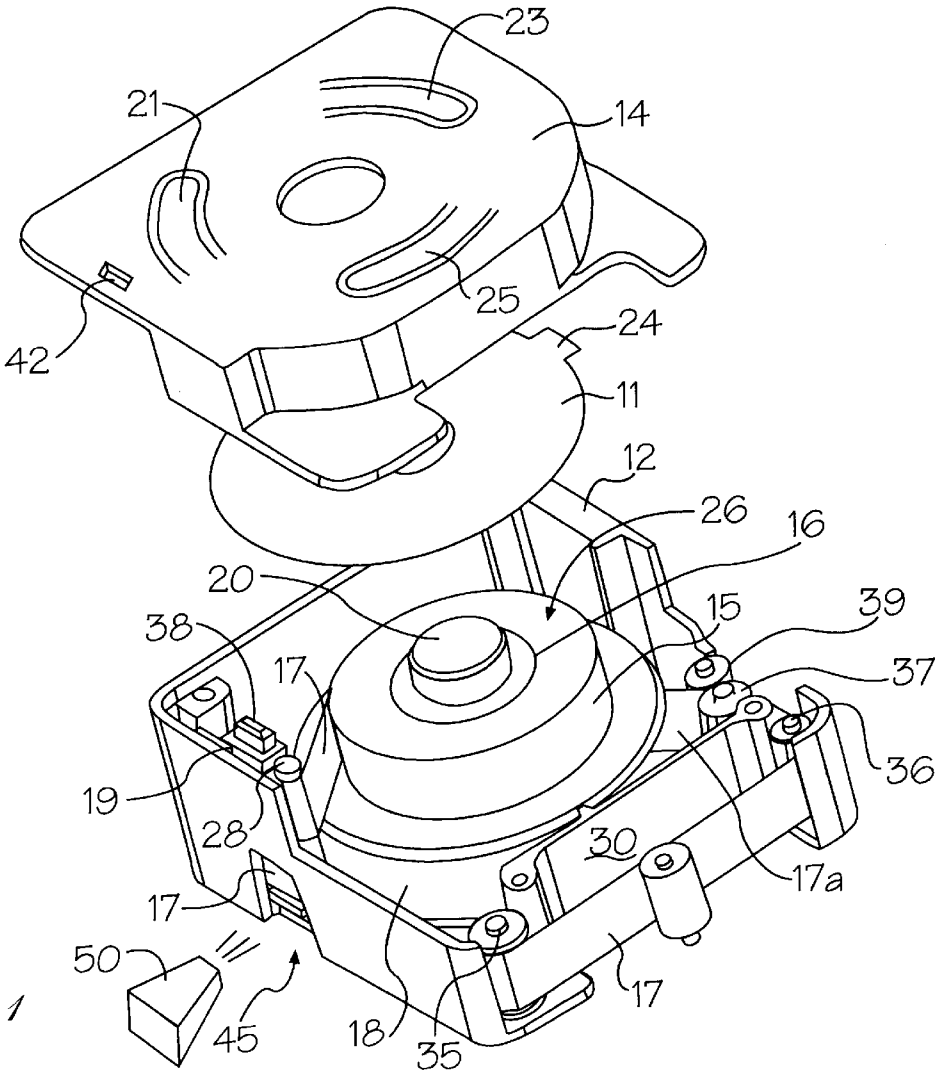
FIG. 1 illustrates a schematic, perspective, exploded, frontal view of the ribbon cassette of this invention.
Figure 2:
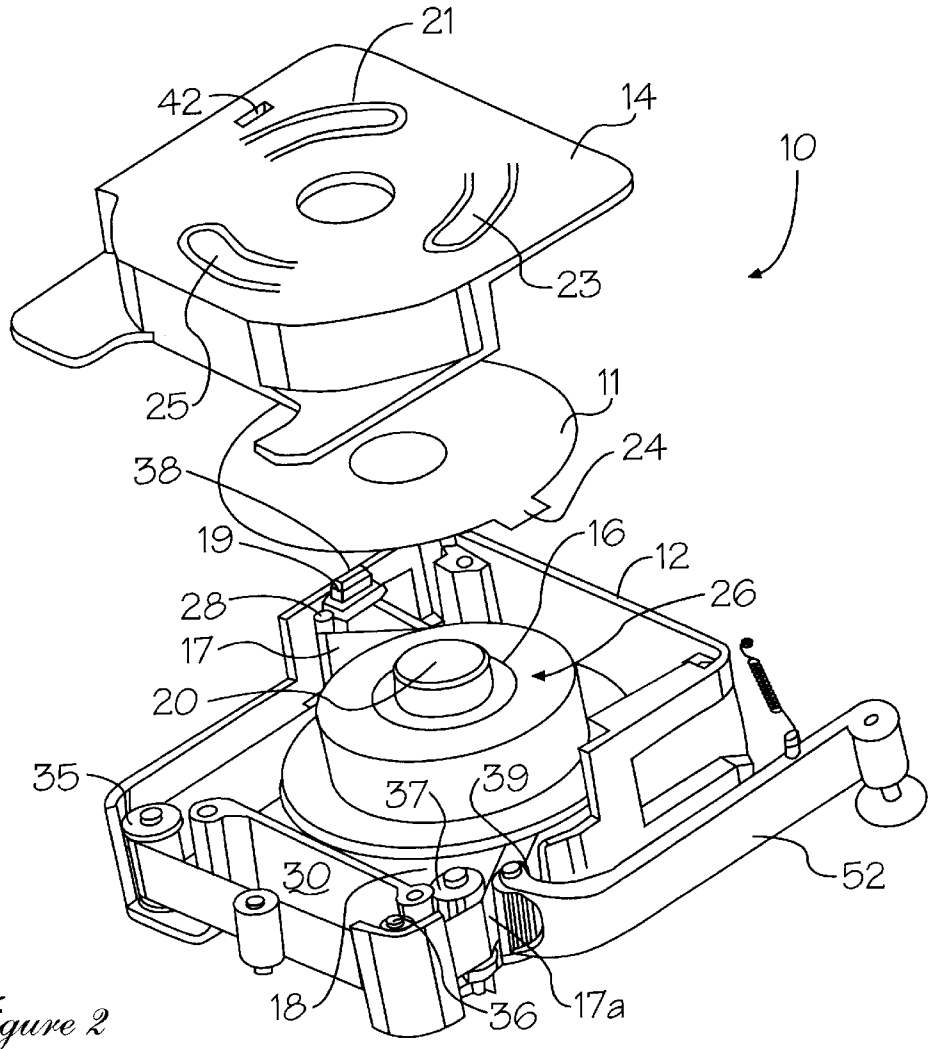
FIG. 2 depicts a schematic, perspective, exploded, left side view of the ribbon cassette of this invention.
Figure 3:
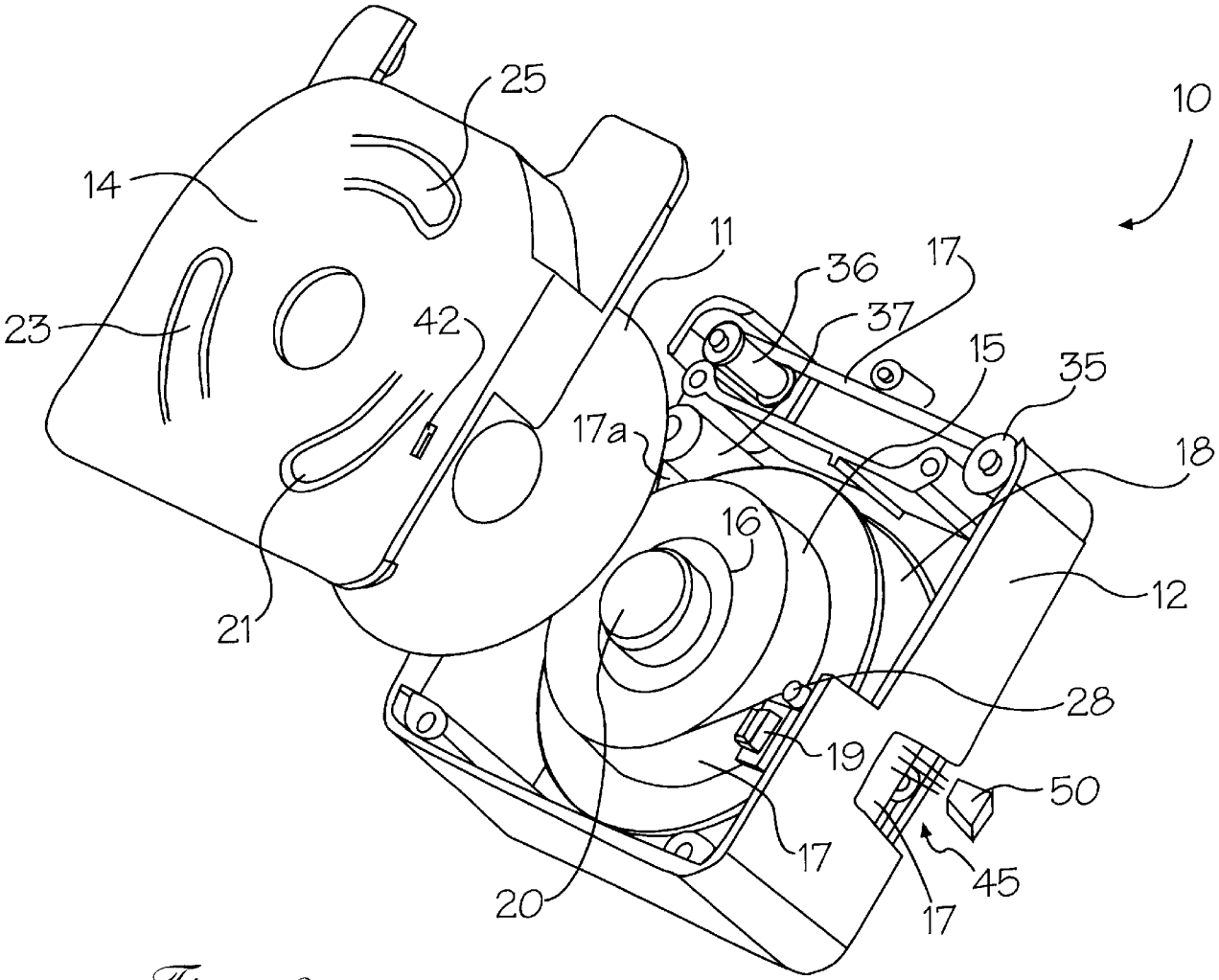
FIG. 3 show a schematic, perspective, exploded, right side view of the ribbon cassette of this invention.

Now referring to FIGS. 1 through 3, the ribbon cassette 10 of this invention is illustrated. The ribbon cassette 10 comprises a housing 12 having a cover plate 14. A tape dispensing spool or core 16, having a tape or ribbon 15 wound thereupon, is integrally formed and affixed to a storage spool mandrel (not shown) disposed immediately below it, within the housing 12. The storage spool mandrel 18 stores the tape 15 dispensed from the dispensing spool 16, allowing the tape to wind thereupon.

The respective spools of tape 16 and 18 are wound on their respective mandrels, about a common rotatable shaft 20. The shaft 20 is rotatively mounted within the bearing hole 29 disposed in cover plate 14, and a corresponding bearing hole (not shown) disposed in the bottom of housing 12. The cover plate 14 is affixed to the housing 12, capturing the shaft 20 between the cover 14 and the housing 12.

A flexible, thin-walled friction plate 11 is disposed immediately below the cover plate 14, and is keyed to the housing 12 by tab 24. The cover plate 14 comprises three, integrally formed leaf springs 21, 23, and 25, respectively, formed as part of the cover plate 14. The leaf springs create a biasing against the friction plate 11 disposed below the cover plate 14. This, in turn, causes the friction plate 11 to bear against the top 26 of the wound dispensing ribbon 15 disposed upon the dispensing spool core 16. This causes a frictional loading upon the edges of the wound dispensing ribbon 15, which eliminates or substantially reduces loose gaps from forming in the dispensed ribbon 17.

Figure 4:
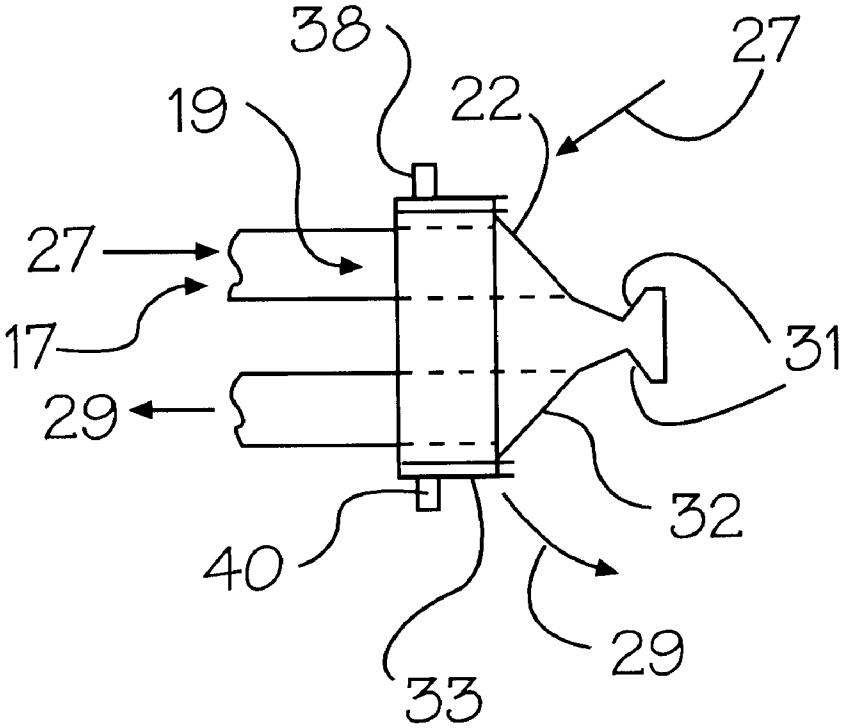
FIG. 4 illustrates a front view of the chevron disposed in the ribbon cassette of FIGS. 1 through 3, for reversing the ribbon direction within the cassette housing.

The dispensed ribbon 17 is fed to a uniquely designed chevron 19, shown in greater detail in FIG. 4. The dispensed tape 17 is guided (arrow 27) towards the upper diagonal surface 22 of the chevron 19 by the cylindrical capstan 28 (FIGS. 1 through 3). The dispensed ribbon 17 rides over the upper diagonal surface 22, wraps around the back of the chevron 19 and over the lower diagonal surface 32 of chevron 19. In so traversing the chevron 19, the dispensed ribbon 17 is caused to change elevation and reverse direction, as indicated by arrows 27 and 29, respectively. The dispensed ribbon 17 is now capable of being wound upon the storage spool 18.

A lip 31 at the distal end of the upper and lower diagonal surfaces 22 and 32, prevents the ribbon 17 from sliding off of diagonal surfaces 22 and 32. Similar lips 33, disposed at the extreme ends of the diagonal surfaces 22 and 32, serve a similar function. The chevron 19 is affixed between the cover 14 and the housing 12 by means of upper and lower tenons 38 and 40, respectively. The upper tenon 38 fits into mortise 42 in the cover 14, and the lower tenon 40 fits into a similar mortise (not shown) in the housing 12.

The dispensed ribbon 17 is fed from the chevron 19 to the front cylindrical capstans 35 and 36, respectively, as best observed in FIGS. 1 and 2. The ribbon 17 is caused to be stretched between these two capstans 35 and 36, where it can be accessed by the thermal print head (not shown) of the MICR encoder printer. A check or other document for receiving MICR characters passes between platen 30 and stretched printing ribbon 17. When the thermal print head contacts the back of the stretched ribbon 17 and is energized, MICR characters are printed upon the check or other document. The used ribbon 17*a* is then guided to the storage spool 18 through two meshing gears 37 and 39, as best observed in FIG. 2. The meshing gears 37 and 39 positively capture the used ribbon 17*a,* thus causing the ribbon to be positively advanced without slippage through its passage through the cassette 10 to the storage spool 18. The storage spool 18 is driven at a slightly greater speed than gears 37 and 39 through a slip clutch system (not shown). This ensures that ribbon is reliably stripped away from meshing gears 37 and 39, and wrapped tightly onto storage spool 18. The size of the drive gear 37 is chosen so that the amount of ribbon 17 advanced is equal to or slightly greater than that provided by the print platen rotation. This maximizes the quality of print of the MICR characters to assure compliance with industry standards. In the preferred embodiment, gear 37 (cassette gear) is a 15-tooth gear of approximately 0.265 inches in diameter. Gear 39 (external gear), supported on arm 52, is a 12-tooth gear of approximately 0.219 inches in diameter. In a typical application, gears 37 and 39 are rotated 720 degrees which causes ribbon 17 to be advanced approximately 1.923 inches during each ribbon advance operation.

Referring to FIGS. 1 and 3, an aperture 45 is disposed in the housing adjacent chevron 19. The purpose of the aperture 45 is to observe the ribbon 17 before it is transported to the capstans 35 and 36, for contact with the printing elements. The aperture 45 also serves as a window by which the end of the ribbon 17 can be determined. The end of the ribbon can be fitted with a silverized or otherwise reflective surface. In an alternate embodiment, the final section (not shown) of the ribbon 17 may be transparent and the portion of the cassette immediately behind the ribbon may be a reflective surface. The end of ribbon surface is displaced a sufficient distance from the printing head to ensure that the current MICR printing may be successfully completed (i.e., there is at least enough thermal ribbon to complete encoding the amount field of the check currently being processed). A photodetector 50, disposed opposite the window provided by aperture 45, can sense the reflection of its beam upon the metallized or reflective surface of the end portion of the ribbon. In so doing, the end of ribbon can be determined, thus signalling the operator to change the cassette 10 immediately after the current printing operation is completed. Alternatively, the end of ribbon may be transparent, so that light can be reflected to the photodetector 50 from an internal reflective component.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

The present invention is particularly directed to use in a transaction printer which will employ varying features and functions, described in differing aspects, in any one or more of the following group of copending patent applications, all filed concurrently on Aug. 7, 1998: AXI-126 to Martinez et al for "COMPACT RIBBON CASSETTE", Ser. No. 09/130,598; AXI-139 to Martinez et al for "THERMAL TRANSFER MICR POINT-OF-SALE PRINTER", Ser. No. 09/131,109; AXI-140 to Martinez for "RIBBON CASSETTE HAVING END OF RIBBON SENSING", Ser. No. 09/130,716; AXI-141 to Rowlands for "POINT-OF-SALE MICR PRINTING AND READING", Ser. No. 09/130,811; AXI-143 to Turner for "RIBBON CASSETTE FOR IMPACT PRINTER", Ser. No. 09/130,699; AXI-145 to Martinez et al for "COMPACT RIBBON CASSETTE WITH INTEGRAL FRICTION PLATE", Ser. No. 09/131,189; AXI-147 to Martinez et al for "THERMAL TRANSFER MICR PRINTER", Ser. No. 09/131,110; AXI-148 to Martinez et al for "THERMAL TRANSFER MICR PRINTER", Ser. No. 09/131,112; and AXI-149 to Walls et al for "CHECK PROCESSING", Ser. No. 09/131,111; and AXI-150 to Martinez et al for "CHECK PROCESSING MICR PRINTER AND ENCODER", Ser. No. 09/130,700.

What is claimed is:

1. A ribbon cassette, comprising:

a housing supporting a rotatable shaft for rotation therein;

a dispensing spool of ribbon mounted for rotation upon said rotatable shaft, said dispensing spool dispensing a quantity of ribbon;

a storage spool for storing ribbon dispensed by said dispensing spool of ribbon, said storage spool mounted upon said rotatable shaft adjacent said dispensing spool; and said spring-loaded arm disposed outside said housing;

a pair of first and second meshing gears, said first meshing gear disposed within said housing, and said second meshing gear mounted to said spring-loaded arm, and biased towards said first meshing gear, said pair of first and second meshing gears receiving ribbon dispensed by said dispensing spool and passing said ribbon to said storage spool, whereby said pair of first and second meshing gears cause the ribbon to be positively advanced without slippage in its passage through the cassette.

2. The ribbon cassette in accordance with claim 1, wherein said first meshing gear comprises a first number of teeth and said second meshing gear comprises a second number of teeth.

3. The ribbon cassette in accordance with claim 2, wherein said first number of teeth is greater than said second number of teeth.

4. The ribbon cassette in accordance with claim 3, wherein said first number of teeth and said second number of teeth are in a range of 12 to 15, inclusive.

5. The ribbon cassette in accordance with claim 3, wherein said dispensing spool and said storage spool are integrally formed about said rotatable shaft.

6. A ribbon cassette, comprising:

a housing supporting a rotatable shaft for rotation therein;

a dispensing spool of ribbon and a storage spool commonly mounted for rotation upon said rotatable shaft, said dispensing spool dispensing a quantity of ribbon to said storage spool; and said spring-loaded arm disposed outside said housing;

a pair of first and second meshing gears, said first meshing gear disposed within said housing, the second meshing gear mounted to said spring-loaded arm, and biased towards said first meshing gear, said meshing gears receiving ribbon dispensed by said dispensing spool and passing said ribbon to said storage spool, whereby said meshing gears cause the ribbon to be positively advanced without slippage in its passage through the cassette.

7. The ribbon cassette in combination with a spring-loaded arm, said ribbon cassette in accordance with claim 6, wherein said first meshing gear comprises a first number of teeth and said second meshing gear comprises a second number of teeth.

8. The ribbon cassette in accordance with claim 7, wherein said first number of teeth is greater than said second number of teeth.

9. The ribbon cassette in accordance with claim 8, wherein said first number of teeth and said second number of teeth are in a range of 12 to 15, inclusive.

10. The ribbon cassette in accordance with claim 7, wherein said dispensing spool and said storage spool are integrally formed about said rotatable shaft.

* * * * *